US005200576A

United States Patent [19]

Schrader et al.

[11] Patent Number: 5,200,576

[45] Date of Patent: Apr. 6, 1993

[54] MULTI-POINT CONTACT COMPRESSION CONNECTOR

[75] Inventors: Gary E. Schrader, Manchester; Robert K. Annan, Merrimack, both of N.H.

[73] Assignee: Burndy Corporation, Norwalk, Conn.

[21] Appl. No.: 842,767

[22] Filed: Mar. 2, 1992

Related U.S. Application Data

[63] Continuation of Ser. No. 655,987, Feb. 15, 1991, abandoned.

[51] Int. Cl.[5] ..... H01R 4/18

[52] U.S. Cl. ..... 174/94 R; 174/71 R; 403/275; 403/391

[58] Field of Search ..... 174/71 R, 94 R, 84 C; 403/391, 275

[56] References Cited

U.S. PATENT DOCUMENTS

| | | | |
|---|---|---|---|
| 2,307,216 | 1/1943 | Graham | 174/84 C |
| 2,956,108 | 10/1960 | Brenner | 174/94 R |
| 3,183,025 | 5/1965 | Lynch, Jr. et al. | 174/94 R X |
| 3,235,654 | 2/1966 | Eldridge, Jr. | 174/94 R |
| 3,236,693 | 2/1966 | Toedtman | 174/94 R |
| 3,322,888 | 5/1967 | Zemels | 174/94 R |
| 3,340,352 | 9/1967 | Teagno et al. | 403/391 |
| 3,354,517 | 11/1967 | Levinsky | 174/71 R |
| 3,916,517 | 11/1975 | Luongo | 174/84 C X |
| 4,828,516 | 5/1989 | Shaffer | 439/877 |
| 5,036,164 | 7/1991 | Schrader et al. | 174/94 R |
| 5,103,068 | 4/1992 | Schrader | 174/94 R |

*Primary Examiner*—Morris H. Nimmo
*Attorney, Agent, or Firm*—Hoffman, Wasson & Gitler

[57] ABSTRACT

A multipoint contact compression connector provided with a plurality of recesses to include a like number of electrical conductors or cables therein. When placed in an appropriate crimping device, the connector would contact the interior die surfaces in at least four points, in such a manner, so as to secure at least three conductors or cables in place.

11 Claims, 3 Drawing Sheets

MULTI-POINT CONTACT COMPRESSION CONNECTOR

This is a continuation of copending application Ser. No. 07/655,987 filed on Feb. 15, 1991 now abandoned.

BACKGROUND OF THE INVENTION

This invention broadly pertains to electrical compression connectors for single strand or multistrand wire or cable conductors. More specifically, the present invention relates to compression-type electrical connectors for connecting at least three, and preferably four, conductors together in an electrical power distribution system.

Prior art compressible connectors are known in which more than three wires or cables are included in a single connector. For example, U.S. Pat. No. 3,354,517 issued to Levinsky describes a compressible connector having the provision for connecting four conductors together. This patent includes closure devices 15,15' which would be difficult to use in a compression device.

U.S. Pat. No. 3,322,888 issued to Zemels illustrates a compressible connector having four recesses extending the length of the connector. However, the two side recesses are not designed to receive conductors therein.

SUMMARY OF THE INVENTION

The present invention overcomes the deficiencies of the prior art by providing a compression connector having recesses for multiple independent conductors which can be crimped by a single tool stroke by standard crimping tools. The particular geometry of the connectors of the present invention optimizes and localizes the force output of the tool to efficiently close the connector, by providing distinct points of contact to the interior surfaces of the crimping dies.

BRIEF DESCRIPTION OF THE DRAWINGS

The foregoing and other objects and advantages of the present invention will be better understood with reference to the following detailed description of preferred embodiments thereof, which are illustrated, by way of example, in the accompanying drawings, wherein.

DETAILED DESCRIPTION OF THE INVENTION

Figure 1:
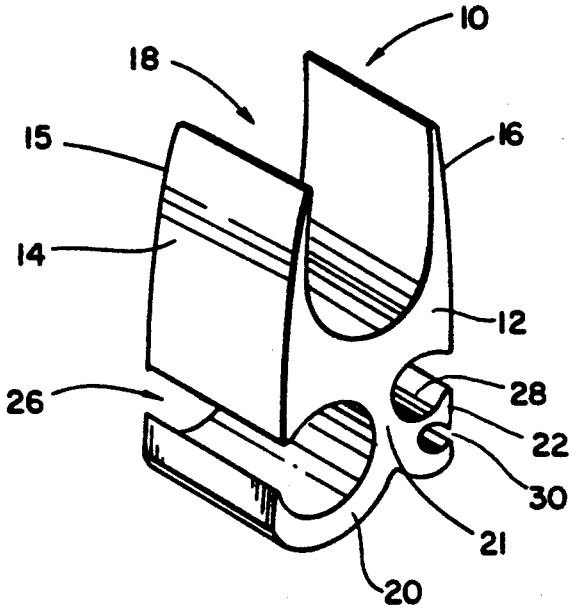
FIG. 1 is a perspective view of a first embodiment of the present invention.
Figure 4:
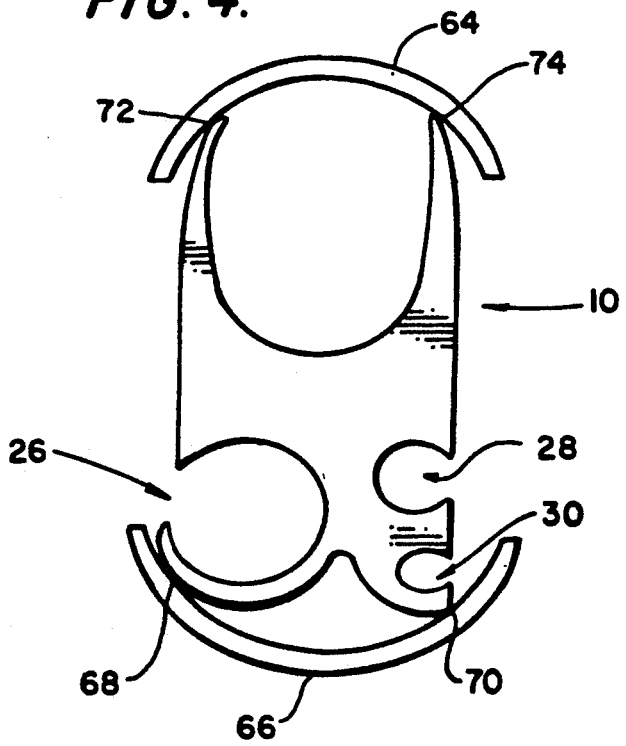
FIG. 4 is a side elevational view of the first embodiment of the present invention provided in a crimping tool.

A first embodiment of the present invention is shown with respect to FIGS. 1 and 4. These figures, illustrate a compressible connector 10 having a main body 12 and two substantially parallel arms 14,16 extending from this main body portion. The distal portion of arm 14 is curved inwardly at 15. However, it should be noted that both of the arms 14 and 16 could be provided without any curved portion. A first recess 18 is formed between the arms 14,16 to allow placement of single strand or multistrand wire conductors or cables therein. A throat portion 21 extends downwardly from the main body 12 and flares out in several directions to form arm portions 20, 22 and 24. A second recess 26 is formed between the body portion 12 and the arm 20. A third recess 28 is formed between the body portion 12 and arm 22, and a fourth recess portion 30 is formed between arm 22 and arm 24. As a minimum, recesses 18 and 40 of FIGS. 1 and 2 must have appropriate conductors located within, while any one of recesses 26,28,30 of FIG. 1 and 46,47,48 of FIG. 2 must be filled. Variously sized wires or conductors can be provided within each of these recess portions.

When placed in a standard crimping tool having die surfaces 64 and 66, the connector 10 would come into contact with the interior surfaces of the dies at points 68, 70, 72 and 74. As a compressive force is applied, these points will come into contact with the die surfaces, and the conductors provided in recesses 26, 28 and 30 will receive direct compressive loads due to the unique geometric relationship between the connector and the die. After the crimping process is terminated, conductors provided in these recesses would be secured in place.

Figure 2:
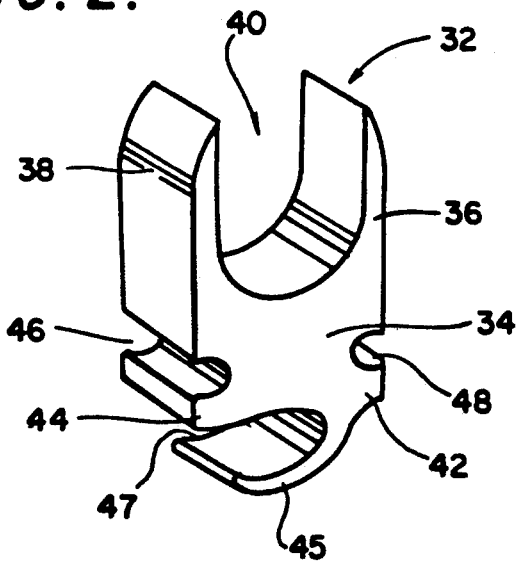
FIG. 2 is a perspective view of a second embodiment of the present invention.
Figure 3:
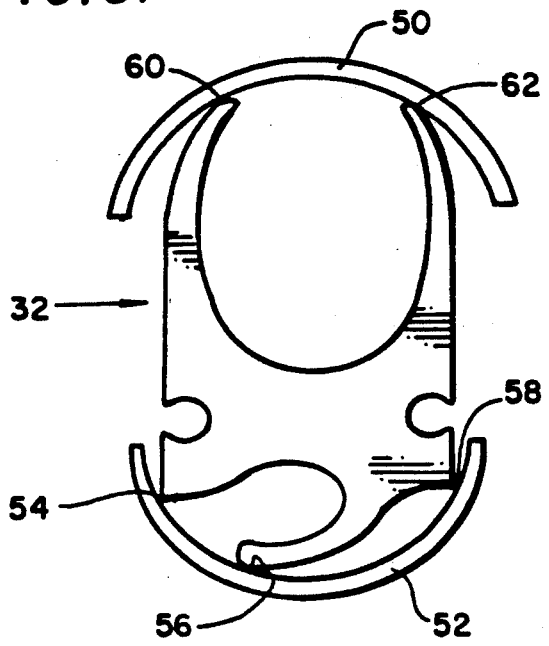
FIG. 3 is a side elevational view of the second embodiment of the present invention provided in a crimping tool.
Figure 5:
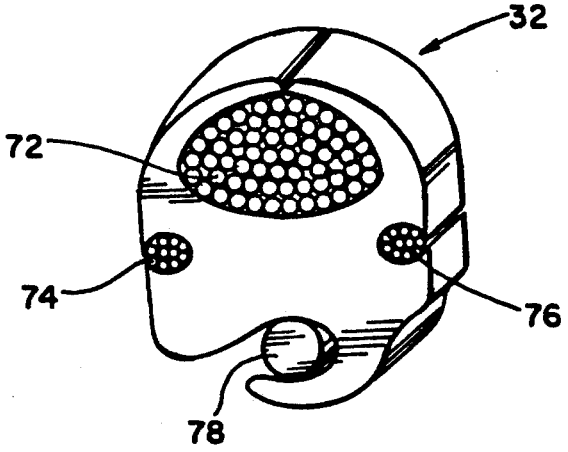
FIG. 5 is a perspective drawing of the second embodiment of the present invention after the crimping process has been completed.

FIGS. 2, 3 and 5 illustrate a second embodiment of the present invention. This embodiment depicts a compressible connector 32 provided with a main body portion 34 and two upwardly extending, substantially parallel leg portions 36,38. A first recess 40 is provided between the leg portions 36,38. A second recess 46 is provided in the central portion 34 below the leg 38, thereby forming a ridge 44. Similarly, a third recess 48 is formed in the body portion 34 below the leg 36, thereby also creating a ridge portion 42. A curved leg 45 extends from the body portion 34 to create a recess portion 47 below and between the recess portions 46 and 48. All of the recess portions 40, 46, 47 and 48 can receive various sized electrical conductors and cables therein.

When placed in a crimping device having die surfaces 50 and 52, the connector 32 would contact the interior surfaces of the dies at points 54, 56, 58, 60 and 62. When compressive force is applied to this connector, it will initially contact at these points 54, 56, 58, 60 and 62. The application of this force would then allow conductors 72, 74, 76 and 78 to be secured and encircled by the body of the connector as illustrated in FIG. 5.

The connector of the present invention can be manufactured from tin-plated copper, aluminum or similar metallic materials which would appropriately deform when pressure is applied in standard mechanical, hydraulic and pneumatic crimping devices.

While the present invention has been illustrated in connection with two preferred embodiments, it should be understood that many variations will occur to those skilled in the art, and that other types of compression connector geometries may be utilized.

What is claimed is:

1. An electrical compression connector for connecting a plurality of conductors or cables, comprising:

a connector body of compressible material adapted to be inserted into a crimping tool having two opposed curved die surfaces for the compression of the connector, said connector body provided with a pair of parallel side faces and a pair of parallel side walls, each of said side walls provided between said side faces, said side faces forming a central web portion, said central web portion provided with at least three recesses extending through the connector body from one of said side faces to the second of said side faces to allow for the inclusion of conductors within each of the recesses, the periphery of said connector body provided with at least four distinct, non-continuous points of contact with said curved die surfaces of a crimping tool when said connector body is inserted within the crimping tool, prior to crimping; and wherein when force is applied to the crimping tool, said connector body will compress, thereby compressing said connector body around the electrical conductors to be provided in said recesses and securing the conductors therein.

2. The compression connector in accordance with claim 1, wherein four recesses are provided between said first and second side faces.

3. The compression connector in accordance with claim 2, wherein said connector body is provided with five distinct points of contact with the curved die surfaces.

4. An electrical compression connector for connecting a plurality of conductors or cables, comprising:

a connector body of compressible material adapted to be inserted into a crimping tool having two opposed curved die surfaces for the compression of the connector, said connector body provided with a pair of parallel side faces and a pair of parallel side walls, each of said side walls provided between said side faces, said side faces forming a central web portion, said central web portion provided with three recesses formed in said side walls and extending through the connector body from one of said side faces to the second of said side faces to allow for the inclusion of conductors within each of the recesses, the periphery of said connector body provided with at least four distinct, non-continuous points of contact with said curved die surfaces of a crimping tool when said connector body is inserted within the crimping tool, prior to crimping; and wherein when force is applied to the crimping tool, said connector body will compress, thereby compressing said connector body around the electrical conductors to be provided in said recesses and securing the conductors therein.

5. The compression connector in accordance with claim 4, wherein said plurality of recesses are formed to a configuration adapted to receive therein conductors of varying cross-sectional dimension.

6. The compression counter in accordance with claim 4, wherein said three recesses are provided between said first and second side faces with at least two of said recesses provided beneath said central web portion and at least one of said recesses located above said web portion and wherein outer wall surfaces adjacent said recess openings are formed to provide said distinct non-continuous points of contact.

7. The compression connector in accordance with claim 6, wherein the recess formed in said upper portion is located between two parallel leg portions projecting upwardly from said web portion with the free ends of said legs providing the first and second of said non-continuous points of contact and wherein at least one of said recesses beneath said web portion has an elongated arm formed at the bottom of said connector with the free end of said arm forming a third non-continuous point of contact and a ridge provided on the side all adjacent said remaining recess in said lower portion providing a fourth point of contact.

8. The compression connector in accordance with claim 4, wherein a fourth recess is provided between said first and second side faces in the lower portion of said connector.

9. The compression connector in accordance with claim 8, wherein said connector body is provided with five distinct points of contact with the curved die surfaces.

10. An electrical compression connector for connecting a plurality of conductors or cables, comprising:

a connector body of compressible material adapted to be inserted into a crimping tool having two opposed curved die surfaces for the compression of the connector, said connector body provided with a pair of parallel side faces and a pair of parallel side walls, each of said side walls provided between said side faces, said side faces forming a central web portion, said central web portion provided with at least three recesses extending through the connector body from one of said side faces to the second of said side faces to allow for the inclusion of conductors within each of the recesses, said central web portion provided with two parallel, upstanding leg portions performing one of said recesses, said upstanding leg portions equal in height with one another, the tips of each of said leg portions provided as points of contact with curved die surfaces of a crimping tool when said connector body is inserted within the crimping tool, prior to crimping; and wherein when force is applied to the crimping tool, said connector body will compress, thereby compressing said connector body around the electrical conductors to be provided in said recesses and securing the conductors therein.

11. The compression connector in accordance with claim 10, wherein the diameter of each of the recesses are unequal with one another.

* * * * *